US005549852A

United States Patent [19]

Bell

[11] Patent Number: 5,549,852

[45] Date of Patent: Aug. 27, 1996

[54] POLYMER COMPOSITION AS DETERGENT BUILDER

[75] Inventor: John M. Bell, Canton, Ga.

[73] Assignee: Rhone-Poulenc Inc., Monmouth Junction, N.J.

[21] Appl. No.: 382,819

[22] Filed: Feb. 3, 1995

[51] Int. Cl.[6] ..... C11D 3/37; C11D 1/12

[52] U.S. Cl. ..... 510/299; 252/24; 252/180; 252/353; 510/301; 510/320; 510/324; 510/327; 510/394; 510/400; 510/476; 526/933

[58] Field of Search ..... 252/554, 174.24, 252/174.23; 526/287

[56] References Cited

U.S. PATENT DOCUMENTS

| | | | |
|---|---|---|---|
| 3,843,585 | 10/1974 | Kangas et al. . | |
| 3,947,396 | 3/1976 | Kangas et al. . | |
| 3,950,296 | 4/1976 | Kangas et al. . | |
| 4,621,127 | 11/1986 | Denzinger et al. | 526/193 |
| 4,647,396 | 3/1987 | Denzinger | 252/174.24 |
| 4,681,686 | 7/1987 | Richardson et al. | 210/699 |
| 5,021,525 | 6/1991 | Montague et al. | 526/210 |
| 5,077,361 | 12/1991 | Hughes et al. | 526/233 |
| 5,175,361 | 12/1992 | Denzinger et al. | 562/590 |
| 5,219,969 | 6/1993 | Uhl et al. | 526/304 |
| 5,256,746 | 10/1993 | Blankenship et al. | 526/233 |
| 5,294,687 | 3/1994 | Blankenship et al. | 526/233 |
| 5,399,285 | 3/1995 | Kanluen | 252/174.23 |

FOREIGN PATENT DOCUMENTS

| | | |
|---|---|---|
| 63264 | 4/1991 | Australia . |
| 82108648 | 9/1982 | European Pat. Off. . |

*Primary Examiner*—Christopher Henderson
*Attorney, Agent, or Firm*—Andrew M. Solomon

[57] ABSTRACT

A novel polymer composition comprising the reaction product of:

(a) between about 75 and about 99.9 weight percent of a monocarboxylic acid or salt monomer;

(b) between about 0 and about 25 weight percent of a dicarboxylic acid, anhydride or salt monomer; and (c) between about 0.1 and about 5.0 weight percent of an acrylic monomer which contains one or more sulfoalkyl groups, where alkyl represents an alkyl moiety containing between 1 and 6 carbon atoms or salt thereof;

the sum of the weight percents of (a), (b) and (c) being 100 percent is provided. The polymer demonstrates excellent soil redeposition properties and is particularly useful as a detergent builder.

13 Claims, No Drawings

POLYMER COMPOSITION AS DETERGENT BUILDER

BACKGROUND OF THE INVENTION

1. Field of the Invention

The present invention relates to a novel polymer which has functionality as a detergent builder. More specifically, the terpolymer is derived from acrylic acid monomers, maleic acid monomers and 2-sulfoethyl methacrylate monomers.

2. Technology Description

A detergent builder is an inorganic or organic salt (in solid form) which provides detergency by chelating the heavy metal ions present in water used to wash fabrics. Known builders include phosphate salts and citrate salts, with sodium citrate being a preferred builder salt.

Polymeric materials have also been suggested as detergent builders. Examples of such materials include those derived from acrylic acid. Specific examples of such polymeric builders include those described in U.S. Pat. No. 5,175,361. According to this publication a polymer useful as an encrustation inhibitor is prepared by copolymerizing by free radical polymerization acrylic acid and maleic acid or acid anhydride monomers. The reference further suggests that up to 10 percent of a noncarboxylated alkene may be additionally polymerized with the monocarboxylic and dicarboxylic monomers. Examples of noncarboxylated alkenes include the following materials: acrylamide, methacrylamide, acrylamidosulfonic acid, vinylsulfonic acid, allylsulfonic acid, vinylphosphonic acid, allylphosphonic acid, vinyl acetate, hydroxyethyl acrylate, hydroxypropyl acrylate, vinylglycol, methyl acrylate and methyl methacrylate.

Other patents which suggest the use of acrylic based materials as detergent builders or dispersants include U.S. Pat. Nos. 5,077,361; 4,621,127; 4,681,686; 5,216,099; 5,256,746; and 5,294,687.

Chemical Abstracts Registry Number 86458-33-5 discloses a polymer formed by the reaction of 2-(Z)-butenedioic acid with 2-propenoic acid and sodium ethenesulfonate.

Despite the above teachings, there still exists a need in the art for a superior polymeric builder material which demonstrates excellent redeposition properties.

BRIEF SUMMARY OF THE INVENTION

In accordance with the present invention a novel polymer in its acidic or neutralized salt form useful as a detergent builder is provided. The polymer salt exhibits excellent soil redeposition properties when utilized in detergent formulations.

One embodiment of the present invention comprises a novel polymer in its acidic or neutralized salt form wherein said polymer is derived from the reaction product of:

(a) between about 75 and about 99.9 weight percent of a monocarboxylic acid or salt monomer;

(b) between about 0 and about 25 weight percent of a dicarboxylic acid, anhydride or salt monomer; and (c) between about 0.1 and about 5.0 weight percent of an acrylic monomer which contains one or more sulfoalkyl groups, where alkyl represents an alkyl moiety containing between 1 and 6 carbon atoms or salt thereof;

the sum of the weight percents of (a), (b) and (c) being 100 percent.

In particularly preferred embodiments, monomer (a) is acrylic acid; monomer (b) is maleic acid and monomer (c) is 2-sulfoethyl methacrylate and wherein the weight percent of monomer (a) is between about 75 and about 85 percent, the weight percent of monomer (b) is between about 15 and about 25 weight percent, and the weight percent of monomer (c) is between about 0.5 and about 2.0 weight percent. In practice the cationic portion of the inventive salt is either an alkali metal, ammonium, alkaline earth metal or transition metal cation, with alkali metal cations, and particularly sodium metal salts being preferred.

Another embodiment of the present invention comprises a detergent composition including the above described novel polymer or polymer salt, which is used as a detergent builder. In practice such compositions may take the form of aqueous solutions of the salts.

Still another embodiment of the present invention comprises a process for cleaning a fabric wherein the fabric is treated with a detergent composition which includes the novel detergent builder.

An object of the present invention is to provide a novel polymeric composition useful as a detergent builder.

Still another object of the present invention is to provide a composition which functions as a detergent and includes a novel detergent builder.

A further object of the present invention is to provide a process for cleaning a fabric by using a composition which includes the novel detergent builder.

These, and other objects, will readily be apparent to those skilled in the art as reference is made to the detailed description of the preferred embodiment.

DETAILED DESCRIPTION OF THE PREFERRED EMBODIMENT

In describing the preferred embodiment, certain terminology will be utilized for the sake of clarity. Such terminology is intended to encompass the recited embodiment, as well as all technical equivalents which operate in a similar manner for a similar purpose to achieve a similar result.

The present invention is directed to a novel polymer in its acidic or salt neutralized form and particularly one that is useful as a detergent builder. The novel polymer is derived from the reaction product of:

(a) between about 75 and about 99.9 weight percent of an ethylenically unsaturated monocarboxylic acid or salt monomer;

(b) between about 0 and about 25 weight percent of an ethylenically unsaturated dicarboxylic acid, anhydride or salt monomer; and (c) between about 0.1 and about 5.0 weight percent of an ethylenically unsaturated acrylic monomer which contains one or more sulfoalkyl groups, where alkyl represents an alkyl moiety containing between 1 and 6 carbon atoms or salt thereof;

the sum of the weight percents of (a), (b) and (c) being 100 percent.

The first monomer used to form the novel polymer is a monocarboxylic acid or acid salt having one or more ethylenically unsaturated bonds. Particularly preferred are ethylenically unsaturated monocarboxylic acids which contain between about 3 and about 10 carbon atoms. Examples of such materials included acrylic acid, methacrylic acid, vinylacetic acid, and mixtures thereof. Particularly preferred is the use of acrylic acid or methacrylic acid, with acrylic acid being most preferred.

For every one hundred parts by weight of the novel polymer composition, the portion derived from monomer (a) represents 75 to about 99.9 percent by weight. Even more preferred is the use of between about 75 to about 85 parts per 100 parts of monomers (a), (b) and (c).

The second monomer used to form the novel polymer is a dicarboxylic acid, anhydride or acid salt having one or more ethylenically unsaturated bonds. Particularly preferred are ethylenically unsaturated dicarboxylic acids, anhydrides or acid salts containing between 4 and about 10 carbon atoms, with ethylenically unsaturated dicarboxylic acids, anhydrides or acid salts containing between 4 and about 6 carbon atoms being even more preferred. Examples of such ethylenically unsaturated dicarboxylic monomers include maleic acid, itaconic acid, mesaconic acid, fumaric acid, methylenemalonic acid, citraconic acid, maleic anhydride and mixtures thereof. Particularly preferred is the use of maleic acid or maleic anhydride.

For every one hundred parts by weight of the novel polymer composition, the portion derived from monomer (b) represents 0 to about 25 percent by weight. Even more preferred is the use of between about 15 to about 25 parts per 100 parts of monomers (a), (b) and (c).

The third monomer used to form the novel polymer is an ethylenically unsaturated acrylic monomer which contains one or more sulfoalkyl groups, where alkyl represents an alkyl moiety containing between 1 and 6 carbon atoms and their salts thereof. Such materials include 2-sulfoethyl methacrylate (2-methyl-2-propenioc acid, 2-sulfoethyl ester).

For every one hundred parts by weight of the novel polymer composition, the portion derived from monomer (c) represents 0. 1 to about 5 percent by weight. Even more preferred is the use of between about 0.5 to about 2.0 parts per 100 parts of monomers (a), (b) and (c).

For the purposes of the present invention, salts of the monomers mentioned under monomers (a), (b) and (c) are alkali metal salts, preferably sodium salts or potassium salts, ammonium salts or organic amine salts, such as those of the tri-$C_1$–$C_4$-alkylamines, mono-, di- or tri-$C_1$–$C_4$ -alkanolamines or mixtures thereof.

Amongst the alkali metal salts whose use is preferred, it is advantageous to employ those which are most easily obtainable, namely the sodium or potassium salts, preferably the sodium salts.

The polymer is prepared by any means known in the art, and preferably by free radical polymerization in a polymerization medium, typically an aqueous medium, wherein between about 0.05 and about 5.0 parts of a free radical initiator is added per 100 parts of monomers (a), (b) and (c). If the initiator is monomer soluble, no water need be added to create a polymerization medium. Examples of free radical initiators which may be selected to catalyze the polymerization reaction include azo, peroxide, persulfate, perester and redox initiators and may be either water soluble or monomer soluble. The amount of initiator added to the solution typically ranges from between about 0.05 to about 10 weight percent of the total monomers with amounts ranging from about 0.1 to about 5 weight percent being particularly preferred and amounts ranging from about 0.1 to about 3.5 weight percent being most preferred. The free radical initiator added is preferably a peroxide or persulfate initiator such as benzoyl peroxide, cumene hydroperoxide, hydrogen peroxide, acetyl peroxide, lauroyl peroxide, ammonium persulfate, sodium persulfate, potassium persulfate and the like.

Sill other free radical initiators which may be selected include peresters such as t-butylperoxypivalate, α-cumylperoxypivalate and t-butylperoctoate.

Although free radical polymerization is the preferred means for producing the novel polymer, other means of initiation such as thermal initiation, mechanical initiation and the like are considered well within the scope of the present invention.

In a preferred embodiment, the polymerization is carried out in an aqueous medium. The concentration is advantageously such that the aqueous solution contains from 20 to 70% by weight, preferably from 30–50% by weight, of total monomers (a), (b) and (c).

In addition to the monomers, initiator and water, conventional aqueous free radical polymerization regulators, such as thioglycolic acid or $C_1$–$C_4$-aldehydes, or chain lengtheners, such as methylene-bis-acrylamide or divinylglycol, may be employed, respectively in amounts of 0.1–10% by weight and 0.5–5% by weight, based on the sum of the monomers.

Neutralizing agents which neutralize one or more of the monomers to convert them into their salt form may also be added to monomer/initiator solution. The neutralizing agents may either be added to solutions of each monomer prior to polymerization, in which case a monomer salt solution is initially added to the polymerization reactor, during the polymerization reaction, or after polymerization. The agents selected are those which are well known for yielding polymer salts. Included amongst such agents are NaOH, KOH, NH4OH, triethanolamine, dimethyl amino ethanol, ethanolamine, and trimethyl hydroxyethyl ammonium hydroxide. The level of neutralizing agent added is such that between about 0 and about 100% of the carboxylic acid groups are neutralized, preferably between about 5 and about 100%, and even more preferably between about 20 and about 95% of the groups.

To synthesize the polymer of the present invention, an aqueous solution of monomer (b) is provided and to it is added sequentially, over 1–10 hours, preferably 2–5 hours, with the amounts of monomer (a) and monomer (c), both advantageously also in aqueous solution. The reaction temperature can vary within wide limits but is advantageously from 60° to 150° C., preferably from 90° to 130° C. If the process is carried out above the boiling point of water, a pressure vessel, such as an autoclave, may be used for the reaction.

Polymerization of the monomers continues until a polymer having a desired molecular weight is produced. In practice, the preferred molecular weight ranges between about 1000 and about 10000 daltons, with a molecular weight between about 2000 and about 5000 daltons being more preferred and a molecular weight between about 2000 and about 3000 daltons being even more preferred. Obtaining the desired molecular weight can be accomplished by adding a chain transfer agent to the polymerization medium. A preferred chain transfer agent is hypophosphorous acid or a salt thereof such as sodium hypophosphite. The amount of chain transfer agent added is inversely proportional to the increase in the polymer molecular weight. Amounts as little of 1 percent by weight of the total amounts of monomers (a), (b) and (c) or as great as 75 percent by weight of the total amounts of monomers (a), (b) and (c) may be added. Particularly preferred is the use of between about 5 to about 10 parts of sodium hypophosphite per 100 parts monomer (a), (b) and (c).

Once the polymer has been synthesized, the aqueous polymer solution obtained can be used directly as it has excellent detergent properties, particularly against $CaCO_3$ encrustation. When used as an aqueous solution, the percentage of polymers comprises between about 20 to 70% by weight, preferably from 40 to 60% by weight of the solution. However, the polymers can also be isolated in a dry form by evaporating the solution, and can, for example, be incorporated into washing powders. Finally, the aqueous solution can also be combined directly with other aqueous solutions containing detergent constituents, and the mixture subjected to conventional spray-drying processes to yield a final detergent composition formulation.

In addition to the novel builder and water, the inventive detergent composition may also include other known supplemental components to provide enhanced properties to the final formulation. These components are added in the amount of between 0 and about 95 weight percent of the final composition. Examples of such components include detergent builders other than the inventive one, surface active agents such as surfactants, enzymes of various types, including proteolytic, amylolytic, lipolytic, cellulytic and carbohydroxylytic types. If enzymes are added, enzyme stabilizers such as those providing a source of calcium ions, boric acids, and various dicarboxylic acids may also be present.

Other supplemental additives include defoamers such as high molecular weight aliphatic acids, especially saturated fatty acids and soaps derived from them; dyes and perfumes; fluorescent or optical brighteners; anti-redeposition agents such as carboxymethyl cellulose and hydroxypropylmethyl cellulose; suspension stabilizing agents and soil release promoters, such as copolymers of polyethylene terephthalate and polyoxyethylene terephthalate (e.g., commercial product sold as Rhone-Poulenc QCJ); antioxidants; softening agents and antistatic agents; photoactivators; and preservatives.

The inventive polymeric composition is particularly useful for cleaning naturally occurring and synthetic fabrics, such as cotton, polyester, wool, silk, rayon, leather, ramie, and mixtures thereof. The cleaning of such fabrics is accomplished by merely immersing them in an aqueous solution including the novel polymer, and optional additives. In practice a home or commercial washing machine is used with the concentration of the inventive detergent composition being between 0.5 and 10.0 grams per liter of wash water.

In addition to their use in cleaning fabrics, the novel polymers may also demonstrate functionality as dispersants for paint formulations, additives for dishwashing detergent formulations, dispersants for kaolin clay slurries and scale inhibitors, dispersants and corrosion inhibitors for water treatment and oil production.

While not wishing to be bound to any scientific theory, the inventors hypothesize that the presence of the sulfoalkyl group of monomer (c) provides added detergency to the novel polymer, particularly as compared to other acrylic based detergent materials which do not include the sulfoalkyl group.

The invention is described in greater detail by the following non-limiting examples.

COMPARATIVE EXAMPLE 1

A first feed is formed by adding to a solution of 5.77 parts of maleic anhydride in 17.03 parts water a neutralizer co-feed of 19.05 parts of NaOH (50% solution). This mixture is cooled to about 100° F. A second feed contains 23.10 parts of glacial acrylic acid. A third feed is formed by adding 2.43 parts of sodium hypophosphite to 4.81 parts water. A fourth feed is formed by adding 0.95 parts sodium persulfate to 4.81 parts water. These four feeds are added to 10.20 parts water at 90° C. Feeding of the four feeds occurs over a three hour period while keeping the reactor at 90° C. After the four streams have been fed to the reactor, the reactor is held at 90° C. for one hour. The reactor lo is cooled to ambient conditions. A final neutralization feed of 11.84 parts of NaOH (50% solution) is added to adjust the pH to the desired level.

The resultant polymer solution has a solids contents of about 43.62%, a pH of 6.70, and a viscosity of 50–200 cps as measured by a Brookfield Viscometer at a shear rate of 30 rpm, Spindle No. 2. The molecular weight of the formed polymer, which is believed to be a 80 percent by weight monocarboxylic acid and 20 percent by weight dicarboxylic acid anhydride is 2600 daltons.

EXAMPLE 2

A first feed is formed by adding to a solution of 6.19 parts of maleic anhydride in 18.26 parts water and a neutralizer co-feed of 20.43 parts of NaOH (50% solution). This mixture is cooled to about 100° F. A second feed contains 24.76 parts of glacial acrylic acid. A third feed is formed by adding 2.60 parts of sodium hypophosphite and 0.31 parts of 2-sulfoethyl methacrylate to 10.32 parts water. A fourth feed is formed by adding 1.02 parts of sodium persulfate to 5.16 parts water. These four feeds are added to 10.94 parts of water at 90° C. Feeding of the four feeds occurs over a three hour period while keeping the reactor at 90° C. After the four streams have been fed to the reactor, the reactor is held at 90° C. for one hour. The reactor is cooled to ambient conditions.

The resultant polymer solution has a solids contents of about 45.59%, a pH of 5.12, and a viscosity of about 70–150 cps as measured by a Brookfield Viscometer at a shear rate of 30 rpm, Spindle No. 2. The molecular weight of the formed polymer, which is believed to be a 79 percent by weight monocarboxylic acid; 20 percent by weight dicarboxylic acid anhydride; and 1 weight percent derived from 2-sulfoethyl methacrylate is 2300 daltons.

EXAMPLE 3

A first feed is formed by adding to a solution of 6.15 parts of maleic anhydride in 18.15 parts water a neutralizer co-feed of 20.31 parts of NaOH (50% solution). This mixture is cooled to about 100° F. A second feed contains 24.61 parts of glacial acrylic acid. A third feed is formed by adding 2.58 parts of sodium hypophosphite and 0.92 parts of 2-sulfoethyl methacrylate to 10.26 parts water. A fourth feed is formed by adding 1.02 parts of sodium persulfate to 5.13 parts water. These four feeds are added to 10.87 parts of water at 90° C. Feeding of the four feeds occurs over a three hour period while keeping the reactor at 90° c. After the four streams have been fed to the reactor, the reactor is held at 90° C. for one hour. The reactor is cooled to ambient conditions.

The resultant polymer solution has a solids contents of about 46.77%, a pH of 5.08, and a viscosity of 70–150 cps as measured by a Brookfield Viscometer at a shear rate of 30 rpm, Spindle No. 2. The molecular weight of the formed polymer, which is believed to be a 78 percent by weight monocarboxylic acid; 19 percent by weight dicarboxylic acid anhydride; and 3 weight percent derived from 2-sulfoethyl methacrylate is 2900 daltons.

EXAMPLE 4

A first feed is formed by adding to a solution of 1102 parts of maleic anhydride in 2444 parts water a neutralizer co-feed of 4080 parts of NaOH (50% solution). This mixture is cooled to about 100° F. A second feed contains 4410 parts of glacial acrylic acid. A third feed is formed by adding 462 parts of sodium hypophosphite and 55 parts of 2-sulfoethyl methacrylate to 925 parts water. A fourth feed is formed by adding 181 parts of sodium persulfate to 915 parts water. These four feeds are added to 2899 parts of water at 100° C. Feeding of the four feeds occurs over a three hour period while keeping the reactor at a slight reflux. After the four streams have been fed to the reactor, the reactor is held at 100° C. for one hour. The reactor is cooled to ambient conditions. 17600 parts of solution are produced.

The resultant polymer solution has a solids contents of about 45.5%, a pH of 5.0, and a viscosity of about 70–150 cps as measured by a Brookfield Viscometer at a shear rate of 30 rpm, Spindle No. 2. The molecular weight of the formed polymer, which is believed to be a 79 percent by weight monocarboxylic acid; 20 percent by weight dicarboxylic acid anhydride; and 1 weight percent derived from 2-sulfoethyl methacrylate is 2700 daltons.

EXPERIMENTAL TESTING

To determine the effectiveness of the inventive compositions against encrustation as compared to compositions which do not include a portion derived from the sulfoalkyl acrylate monomer and other commercially successful compositions, the following test procedure is performed on black cloth. Samples that are tested include Comparative Example 1, Example 2, Example 3, Colloid 205, a commercial product manufactured by Rhône-Poulenc Inc., Colloid 208, a commercial product manufactured by Rhône-Poulenc Inc., and a blank which contains only water.

Procedure:

1. Prior to washing, the reflectance of the black cloth swatches are recorded on a Pacific Scientific Colorgard System/05 Colorimeter.
2. Prior to washing, polymer solutions are prepared such that 3 milliliters would contain 0.022 grams of polymer solids.
3. Six liters of synthetic hard water are heated to 95° F.
4. The Terg-O-Tometer water bath is set for 95° F.
5. One liter of heated synthetic hard water is added to each bucket of the Terg-O-Tometer.
6. The detergents are weighed on an analytical balance. Syringes are filled with solutions from Step 2.
7. The detergents are added to each Terg-O-Tometer bucket. The Terg-O-Tometer is run for two minutes. While running, the polymers are added from the syringes to each bucket.
8. After the 2 minute mixing period, the swatches are added as quickly as possible and washed for 10 minutes.
9. Six liters of synthetic hard water are heated to 95° F. for use in the rinse cycle.
10. Upon completion of the wash cycle, the wash water is immediately discarded, the swatches are squeezed by hand to remove excess water, the pots and agitators are rinsed with tap water, the preheated rinse water is added to the pots, and the swatches are placed back in their respective buckets.
11. The swatches are rinsed for 5 minutes.
12. The swatches are removed from the rinse water, squeezed by hand to remove excess water and hung to dry at 60° C. in a gravity convection oven for 45 minutes.
13. This procedure is repeated for ten cycles.
14. After the fifth and tenth cycles, the reflectance of the washed cloths is recorded on the Colorimeter and compared to the reflectance measured before washing. The difference in values is referred to as the Delta Reflectance.

Test Conditions are as follows:

| | |
|---|---|
| Water Temperature | 95° F. |
| Water Hardness | 300 ppm (2:1 Ca/Mg) |
| Detergent Concentration | 1.61 gm/l |
| Polymer Concentration (active) | 0.022 gm/l |
| Terg-O-Tometer Speed | 100 |
| Dissolve Time | 2 minutes |
| Wash Time (per wash) | 10 minutes |
| Rinse Time (per rinse) | 5 minutes |
| Test Cloth (each Bucket) | 4 swatches 5" × 5" black cotton. |

This procedure is performed a first time with Colloid 205, Comparative Example 1, Example 2 and Example 3 compositions and is performed a second time with the blank, Colloid 205, Example 2 and Colloid 208 compositions. The test results are shown in Tables 1 and 2 below. The values listed are the Delta Reflectance, Y Scale. A low value for Delta Reflectance is in indicator of excellent cleaning performance.

TABLE 1

| | Colloid 205 | Comp. Ex. 1 | Example 2 | Example 3 |
|---|---|---|---|---|
| Five Washes | 0.08 | 0.05 | 0.02 | 0.05 |
| Ten Washes | 0.61 | 0.61 | 0.45 | 0.61 |

TABLE 2

| | Blank | Colloid 205 | Example 2 | Colloid 208 |
|---|---|---|---|---|
| Five Washes | 0.59 | 0.08 | 0.00 | −0.01 |
| Ten Washes | 2.01 | 0.82 | 0.57 | 0.67 |

The above data demonstrates that the inventive polymers provide excellent performance against $CaCO_3$ encrustation. In fact, the polymer of Example 2 demonstrates superior performance as compared to a acrylic acid/maleic acid copolymer (Comparative Example 1) and as compared to two commercially successfully products (Colloid 205 and Colloid 208).

Having described the invention in detail and by reference to the preferred embodiments thereof, it will be apparent that modifications and variations are possible without departing from the scope of the appended claims.

What is claimed is:

1. A detergent composition or dispersant composition including a novel polymer composition wherein said polymer comprises the reaction product of:

(a) between about 75 and about 99.9 weight percent of a monocarboxylic acid or salt monomer;

(b) between about 0 and about 25 weight percent of a dicarboxylic acid, anhydride or salt monomer; and (c) between about 0.1 and about 5.0 weight percent of an acrylic monomer which contains one or more sulfoalkyl groups, where alkyl represents an alkyl moiety containing between 1 and 6 carbon atoms or salt thereof;

the sum of the weight percents of (a), (b) and (c) being 100 percent.

2. The composition according to claim 1 wherein monomer (a) is selected from the group consisting of acrylic acid, methacrylic acid, vinylacetic acid and mixtures thereof.

3. The composition according to claim 2 wherein monomer (a) comprises acrylic acid.

4. The composition according to claim 1 wherein monomer (a) comprises between about 75 to about 85 parts by weight per 100 parts by weight of monomers (a), (b) and (c).

5. The composition according to claim 1 wherein monomer (b) is selected from the group consisting of maleic acid, itaconic acid, mesaconic acid, fumaric acid, methylenemalonic acid, citraconic acid, maleic anhydride, their salts and mixtures thereof.

6. The composition according to claim 5 wherein monomer (b) is selected from the group consisting of maleic anhydride, maleic acid and the salts thereof.

7. The composition according to claim 1 wherein monomer (b) comprises between about 15 to about 25 parts by weight per 100 parts by weight of monomer (a), (b) and (c).

8. The composition according to claim 1 wherein monomer (c) comprises 2-sulfoethyl methacrylate.

9. The composition according to claim 8 wherein monomer (c) comprises between about 0.5 to about 2.0 parts by weight per 100 parts by weight of monomers (a), (b) and (c).

10. The composition according to claim 1 which is partially or completely neutralized.

11. The composition according to claim 1 which is in the form of an aqueous solution and wherein the amount of the polymer formed from monomers (a), (b) and (c) comprise between about 20 to about 70 weight percent of said solution.

12. The composition according to claim 1 which is in the form of an aqueous solution and wherein the amount of the polymer formed from monomers (a), (b) and (c) comprise between about 30 to about 50 weight percent of said solution.

13. The composition according to claim 1 further comprising one or more of the following additive materials: detergent builders other than that defined by monomers (a), (b) and (c), surface active agents, enzymes, enzyme stabilizers, high molecular weight aliphatic acids, dyes and perfumes, fluorescent or optical brighteners, anti-redeposition agents, suspension stabilizing agents and soil release promoters, antioxidants, softening agents and antistatic agents, photoactivators and preservatives.

* * * * *